US008843046B2

(12) United States Patent
Nawa et al.

(10) Patent No.: US 8,843,046 B2
(45) Date of Patent: Sep. 23, 2014

(54) IMAGE HEATING APPARATUS

(71) Applicant: Canon Kabushiki Kaisha, Tokyo (JP)

(72) Inventors: Masahiro Nawa, Kumamoto (JP); Kazuaki Aoki, Moriya (JP); Shouhei Takeda, Toride (JP); Yasuo Nami, Toride (JP); Naoyuki Yamamoto, Kashiwa (JP); Koji Takematsu, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 13/648,547

(22) Filed: Oct. 10, 2012

(65) Prior Publication Data

US 2013/0094887 A1 Apr. 18, 2013

(30) Foreign Application Priority Data

Oct. 14, 2011 (JP) ..... 2011-226635

(51) Int. Cl.
*G03G 15/20* (2006.01)

(52) U.S. Cl.
CPC ..... *G03G 15/2053* (2013.01)
USPC ..... 399/330

(58) Field of Classification Search
USPC ..... 399/330; 384/418, 441, 903
See application file for complete search history.

(56) References Cited

U.S. PATENT DOCUMENTS

| | | | | |
|---|---|---|---|---|
| 2,897,022 | A * | 7/1959 | Marola | 384/584 |
| 7,196,296 | B2 | 3/2007 | Yamamoto | |
| 7,199,339 | B2 | 4/2007 | Shirakata et al. | |
| 7,205,514 | B2 | 4/2007 | Suzuki et al. | |
| 7,238,924 | B2 * | 7/2007 | Kondo et al. | 219/619 |
| 7,268,326 | B2 | 9/2007 | Yamamoto et al. | |
| 7,268,327 | B2 | 9/2007 | Yamamoto et al. | |
| 7,271,371 | B2 | 9/2007 | Takematsu et al. | |
| 7,319,210 | B2 | 1/2008 | Hosoi et al. | |
| 7,397,017 | B2 | 7/2008 | Hosoi et al. | |
| 7,433,643 | B2 * | 10/2008 | Matsuno et al. | 399/333 |
| 7,442,905 | B2 | 10/2008 | Wakahara et al. | |
| 7,462,804 | B2 | 12/2008 | Shirakata et al. | |
| 7,465,906 | B2 | 12/2008 | Wakahara et al. | |
| 7,539,449 | B2 | 5/2009 | Aoki | |
| 7,558,518 | B2 * | 7/2009 | Fujimoto | 399/328 |
| 7,657,217 | B2 | 2/2010 | Wakahara et al. | |
| 7,756,460 | B2 | 7/2010 | Matsuno et al. | |
| 8,099,008 | B2 | 1/2012 | Nakase et al. | |
| 8,358,949 | B2 | 1/2013 | Nakase et al. | |
| 2007/0048047 | A1 | 3/2007 | Matsuno et al. | |
| 2009/0022528 | A1 | 1/2009 | Matsuno et al. | |
| 2011/0091225 | A1 | 4/2011 | Yamamoto | |
| 2011/0091230 | A1 | 4/2011 | Yamamoto | |
| 2012/0328338 | A1 | 12/2012 | Nawa et al. | |
| 2012/0328342 | A1 | 12/2012 | Takematsu et al. | |

FOREIGN PATENT DOCUMENTS

| | | |
|---|---|---|
| JP | 2007-057644 A | 3/2007 |
| JP | 2009-204731 A | 9/2009 |

* cited by examiner

*Primary Examiner* — Clayton E LaBalle
*Assistant Examiner* — Leon W Rhodes, Jr.
(74) *Attorney, Agent, or Firm* — Fitzpatrick, Cella, Harper & Scinto

(57) ABSTRACT

An image heater a hollow heating roller having a hole at an axial end portion thereof; a bearing supporting the heating roller; a heat insulating bush fitted between an outer surface of the heating roller and the bearing; a retaining ring for retaining the heat insulating bush in an axial direction of the heating roller, the retaining ring including a projection engaging with the hole; an annular spacer provided between the retaining ring and the heat insulating bush, wherein the spacer includes a connecting portion having a connecting hole, the retaining ring includes a hooking portion engaging with the connecting hole.

11 Claims, 11 Drawing Sheets

(a)

(b)

IMAGE HEATING APPARATUS

FIELD OF THE INVENTION AND RELATED ART

The present invention relates to an image heating apparatus used by an image forming apparatus such as a copying machine, a printer, a facsimile machine, a multifunction machine capable of performing two or more functions of preceding machines, and the like.

It has been a common practice to structure an electrophotographic image forming apparatus to form an unfixed toner image on a sheet of recording medium through an electrophotographic image formation process, and fix the unfixed toner image to the sheet of recording medium by applying heat and pressure to the sheet of recording medium and the unfixed toner image thereon (Japanese Laid-open Patent Application 2009-204731).

FIGS. 11(*a*) and 11(*b*) show the structure of one of the lengthwise end portions of the image heating roller (image heating member) disclosed in Japanese Laid-open Patent Application 2009-204731. More concretely, the image heating apparatus is structured so that a bearing 300, an heat-insulating bushing 400, and a retainer clip 500 (annular regulating member), listing from the lengthwise center side of the heating roller, are fitted around each lengthwise end portion of this image heating roller 200.

Further, the retainer clip 500 is provided with such bends that protrude inward, and each of the lengthwise end portions of the heating roller 200 is provided with a pair of through holes 201. Thus, as the retainer clip 500 is fitted around each of the lengthwise end portions of the image heating roller 200, the inwardly protrusive bends of the retainer clip 500 fit into the corresponding through hole of the image heating roller 200, ensuring that the retainer clip 500 prevents the problem that the heat-insulating bushing 400 becomes disengaged from the image heating roller 200 by moving in the lengthwise direction of the image heating roller 200.

However, the above-described structural arrangement disclosed in Japanese Laid-open Patent Application 2009-204731 is problematic for the following reason. That is, the retainer clip 500, which is to rotate with the image heating roller 200, is allowed to rub against the heat-insulating bushing 400. Therefore, it is possible that the bends of the retainer clip 500 will be unintendedly disengaged from the through holes 201 with which the image heating roller 200 is provided.

This problem is prevalent in a case where it is difficult to allow the bends of the retainer clip 500 to protrude inward of the image heating roller 200 through the through holes 201 of the image heating roller 200, by a length large enough to ensure that the bends of the retainer clip 500 do not come out of the through holes 201.

Thus, the inventors of the present invention came up with an idea of placing a spacer which is allowed to freely rotate relative to the image heating roller, between the heat-insulating bushing and retainer clip. However, the studies made by the inventors revealed that this idea also is problematic for the following reason. That is, in spite of the placement of the spacer between the heat-insulating bushing and retainer clip, the retainer clip is allowed to rub against the spacer. Therefore, it is still possible that the retainer clip will disengage from the image heating roller (bends of retainer clips will come out of through holes of image heating member), although the possibility is at an ignorable level.

SUMMARY OF THE INVENTION

Thus, the primary object of the present invention is to provide an image heating apparatus, the retainer clip of which does not unintendedly become disengaged from its image heating roller.

Another object of the present invention is to provide an image heating apparatus, the annular regulating member of which does not unintendedly become disengaged from its image heating member.

According to an aspect of the present invention, there is provided an image heating apparatus a hollow heating roller having a hole at an axial end portion thereof; a bearing supporting said heating roller at an outer surface of said heating roller; a heat insulating bush fitted between an outer surface of said heating roller and said bearing; a retaining ring configured to retain a position of said heat insulating bush relative to said heating roller in an axial direction of said heating roller, said retaining ring including a projecting portion configured to engage with said hole; an annular spacer provided at a position between said retaining ring and said heat insulating bush, wherein said spacer includes a connecting portion having a connecting hole, said retaining ring includes a hooking portion configured to engage with said connecting hole.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, a concrete example of image heating apparatus in accordance with the present invention is described with reference to the appended drawings. However, the following embodiment of the present invention is not intended to limit the present invention in scope. That is, the present invention is applicable, within its scope, to various image heating apparatuses (devices) which are different in structure and function from the one which is going to be described.

[Embodiment 1]

Figure 1:
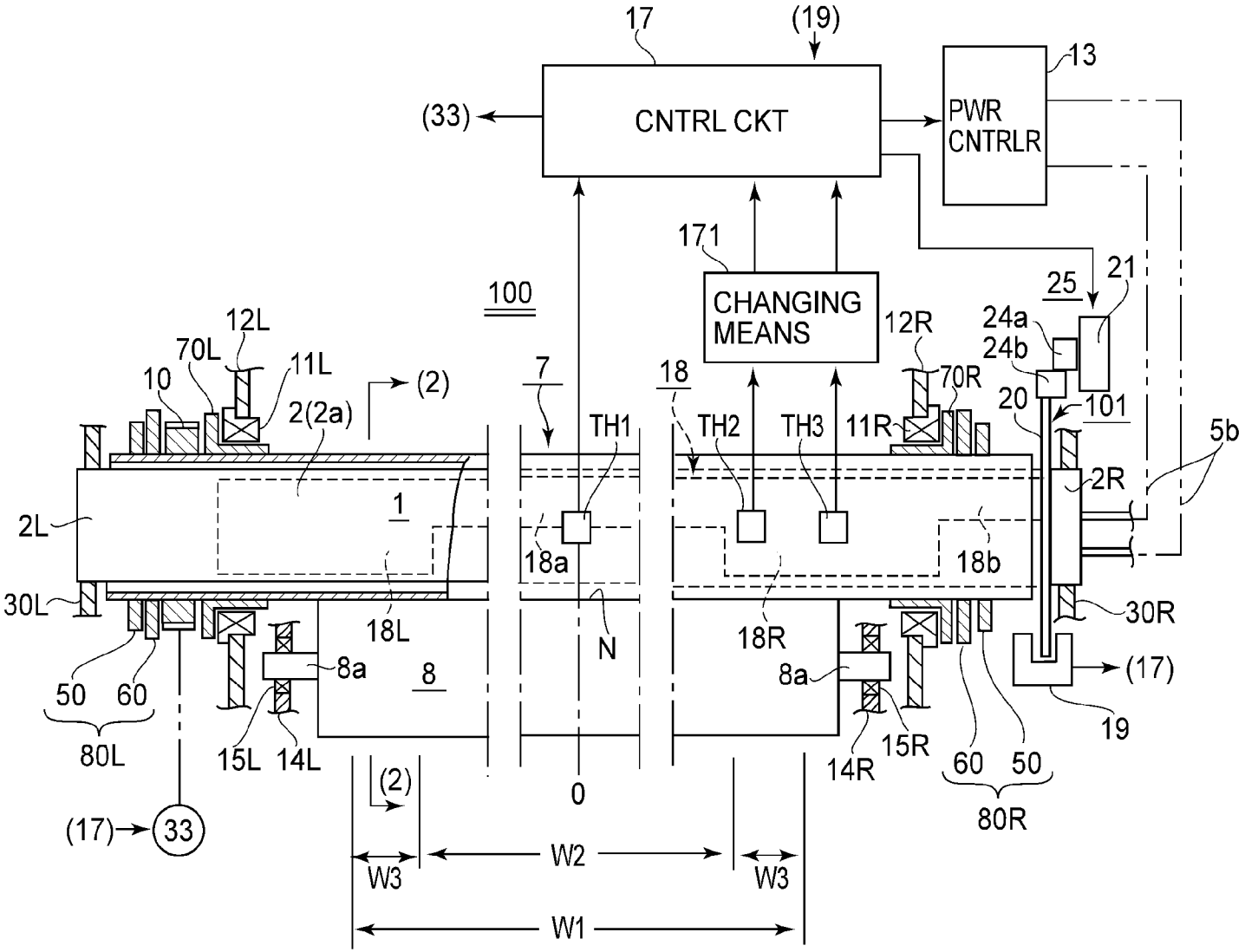
FIG. 1 is a schematic front view of the essential portions of a typical fixing apparatus (device), in which some portions are partially shown to show the portions under them, or not shown at all.
Figure 2:
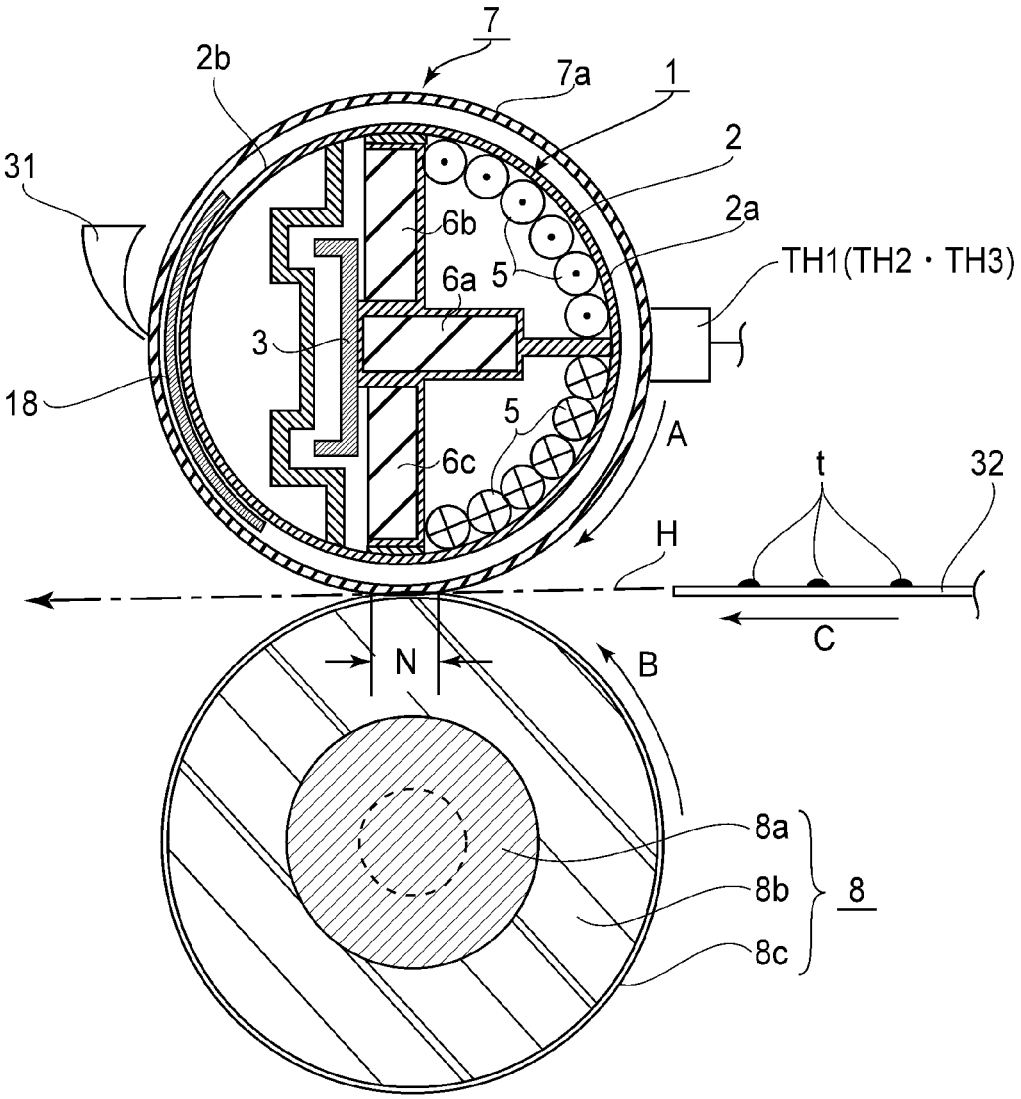
FIG. 2 is an enlarged schematic sectional view of the fixing apparatus shown in FIG. 1, at a vertical plane which coincides with a line (2)-(2) in FIG. 1, as seen from the right-hand side of the drawing.

FIG. 1 is a schematic front view of the essential portions of the fixing apparatus (device) in this embodiment, in which some portions are partially shown to show the portions thereunder, or not shown at all. FIG. 2 is an enlarged sectional view of the fixing apparatus as an image heating apparatus, at a vertical plane which coincides with a line (2)-(2) in FIG. 1, as seen from the right-hand side of the drawing. This fixing apparatus 100 is an image heating apparatus of the so-called electromagnetic induction type. Its heating roller is heated from within itself, and is equipped with a magnetic flux adjusting member for adjusting the amount by which the heat roller is subjected to magnetic flux.

In the following description of the embodiment of the present invention, the front surface (front side) of the fixing apparatus 100 means the surface of the apparatus which is on the recording medium entrance side of the apparatus. The rear surface (rear side) of the fixing apparatus 100 means the surface of the apparatus, which is the opposite surface (recording medium exit side) of the apparatus from the front surface. The left and right sides of the apparatus 100 mean the left and right sides of the apparatus 100 as seen from the front side of the apparatus 100. The top and bottom sides of the apparatus 100 mean the top and bottom sides of the apparatus 100 with reference to the vertical direction. Further, the lengthwise direction of the fixing apparatus 100 and the structural components thereof means the direction which is parallel to the axial line of each of the rotational members of the apparatus 100. It means also the direction which is perpendicular to the recording medium conveyance direction. The widthwise direction means the direction which is perpendicular to the axial line of each of the rotational members of the apparatus 100. Further, it means also the direction which is parallel to the recording medium conveyance direction, and the direction parallel to the widthwise direction.

(1) Fixation Roller

A referential code 7 stands for the fixation roller of the image heating apparatus 100 in this embodiment. The fixation roller 7 is cylindrical and hollow, and functions as an image heating member (heating roller). The fixation roller 7 is desired to be formed of a metallic substance such as iron, nickel, cobalt, etc. Using a ferromagnetic metal (metal which is high in permeability) as the material for the fixation roller 7 makes it possible for the fixation roller 7 to confine by a greater amount, the magnetic flux generated by a heating assembly 1 as the magnetic flux generating means (heating means) positioned in the hollow of the fixation roller 7, than using a metallic substance which is not ferrous. That is, the former can increase the fixation roller 7 in magnetic flux density more than the latter. That is, the former can more efficiently generate eddy current in the wall of the fixation roller 7.

In order to make the fixation roller 7 small in thermal capacity, the fixation roller 7 is formed so that its wall thickness is in a range of roughly 0.3-2 mm. The peripheral surface of the substrate of the fixation roller 7 is covered with a toner parting layer 7*a*. Generally, the toner parting layer 7*a* is formed of PTFE or PFA, and is 10-50 μm in thickness. The fixation roller 7 may be provided with one or more functional layers, for example, a rubber layer (elastic layer), other than the toner parting layer 7*a*. These functional layers are to be placed under the toner parting layer.

The left and right end portions of the fixation roller 7 are fitted with heat-insulating bushings 70L and 70R, bearings 11L and 11R, which are fitted around the left and right end portions of the fixation roller 7, respectively. The heat-insulating bushings 70L and 70R are annular, and function as thermal insulators. The fixation roller 7 is rotatably supported by the left and right plates 12L and 12R of the frame of the fixing apparatus 100, with the placement of the left and right bearings 11L and 11R between the left and right end portions of the fixation roller 7, and the left and right plates 12L and 12R, respectively. The heat-insulating bushings 70L and 70R are for reducing the heat transmission from the fixation roller 7 to the bearings 11L and 11R, respectively. Further, the heat-insulating bushing 70L and 70R are allowed to freely rotate about the fixation roller 7, and the fixation roller 7 is rotatably supported by the bearings 11L and 11R.

Figure 3:
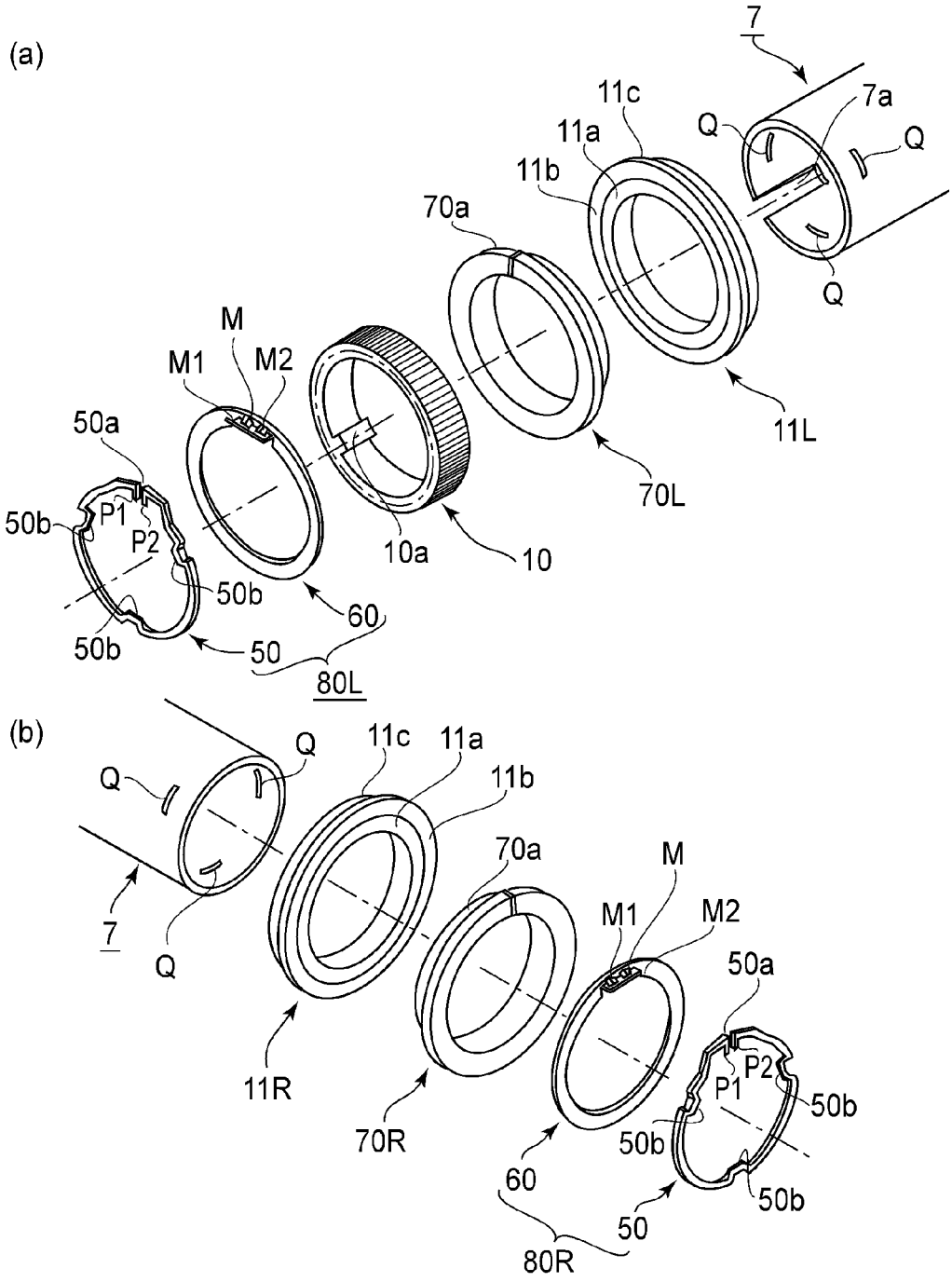
FIGS. 3(*a*) and 3(*b*) are exploded perspective views of the combinations of the components fitted around the lengthwise left and right end portions, respectively, of the fixation roller.

FIGS. 3(*a*) and 3(*b*) are exploded perspective views of one of the combinations of the components fitted around the lengthwise left and right end portions, respectively, of the fixation roller 7. Referential codes 11*a* and 11*b* stand for the inner and outer rings of each of the bearings 11L and 11R, respectively.

A circular fixation roller gear 10 is fitted around the left end portion of the fixation roller 7. It is on the outward side of the heat-insulating bushing 70L in terms of the lengthwise direction of the fixation roller 7. The gear 10 is provided with a protrusion 10*a*, which is on the inward surface of the gear 10. The left end portion of the fixation roller 7 is provided with a slot 7*a*, which corresponds in position to the protrusion 10*a* of the gear 10. Thus, the gear 10 is fitted around the left end portion of the fixation roller 7, from the left end side of the fixation roller 7, in such a manner that the protrusion 10*a* of the gear 10 slides into the slot 7*a* of the fixation roller 7. With the protrusion 10*a* being fitted in the slot 7*a* of the fixation roller 7, the gear 10 is locked with the fixation roller 7, being prevented from rotating around the fixation roller 7.

Further, a retainer 80L, which will be described later, is fitted around the left end portion of the fixation roller 7. It is fitted on the outward side of the gear 10 in terms of the lengthwise direction of the fixation roller 7. Thus, the gearing 10 is kept precisely positioned relative to the fixation roller 7, and also, is prevented from disengaging from the left end portion of the fixation roller 7.

A retainer 80R, which also will be described later, is fitted around the right end portion of the fixation roller 7. It is fitted on the outward side of the heat-insulating bushing 70R in terms of the lengthwise direction of the fixation roller 7. Thus, the heat-insulating bushing 70R (member to be regulated in position) is kept precisely positioned, and also, is prevented from disengaging from the right end portion of the fixation roller 7.

The fixation roller 7 is rotated in the clockwise direction indicated by an arrow mark A in FIG. 2, at a preset peripheral velocity, by the rotational force transmitted from the driving system 33 which is under the control of a control circuit 17.

(2) Pressure Roller

Designated by a referential code 8 is a pressure roller as a pressure applying member. The pressure roller 8 is elastic, and is positioned on the underside of the fixation roller 7, in parallel to the fixation roller 7. It is made up similarly to the fixation roller 7. That is, it is made of a metallic core 8*a*, a silicon rubber layer 8*b*, and a toner parting layer 8*c*. The metallic core 8*a* is formed of iron. The pressure roller 8 is rotatably supported. More concretely, the left and right end portions of the metallic core 8*a* are supported by the pressure roller supporting left and right movable members 14L and 14R, with the placement of pressure roller bearings 15L and 15R, between the pressure roller 8 and pressure roller supporting members 14L and 14R, respectively. Further, the pressure roller supporting left and right members 14L and 14R are kept pressured upward by a pressure applying means (unshown).

Thus, the upwardly facing portion of the peripheral surface of the pressure roller 8 is pressed upon the downwardly facing portion of the peripheral surface of the fixation roller 7, by a preset amount of force (pressure), against the resiliency of the silicon rubber layer 8*b* of the pressure roller 8, forming between the fixation roller 7 and pressure roller 8, a fixation nip N having a preset width in terms of the recording medium conveyance direction C. Therefore, as the fixation roller 7 is rotated, the pressure roller 8 is rotated in the counterclockwise direction indicated by an arrow mark B by the combination of the friction between the fixation roller 7 and pressure roller 8, and the rotation of the fixation roller 7.

In this embodiment, a sheet of recording medium is conveyed through the fixing apparatus 100 (device) in such a manner that its center in terms of its width coincides with the center line of the recording medium passage of the fixing apparatus 100. Referring to FIG. 1, referential codes W1 and W2 stand for the dimension of the largest (widest) and smaller (narrower) sheet of recording medium, respectively, in terms of the direction perpendicular to the recording medium passage in the fixation nip N, properly conveyable through the fixing apparatus 100. A referential code W2 stands for the dimension of each of the two areas of the recording medium passage in the fixation nip N, which will be outside the path of the smaller (narrower) sheet of recording medium when the smaller (narrower) sheet of recording medium is conveyed through the fixing apparatus 100. A referential code O stands for the centerline of the recording medium passage in the fixation nip N, in terms of the direction perpendicular to the recording medium conveyance direction C.

In this embodiment, the width W1 is equal to the width (297 mm) of a sheet of recording paper of size A4, and the width W2 is equal to the width (210 mm) of a sheet of recording medium of size A4R. Further, in the case of the apparatus 100 in this embodiment, the width W1 is equal to the width of a sheet of recording medium of the normal width. Hereinafter, the width W1 will be referred to as the width of the normal sheet of recording medium.

(3) Heating Assembly 1

The heating assembly 1, which is a magnetic flux generating means, is inserted into the hollow of the cylindrical fixation roller 7. It is concentrically positioned with the fixation roller 7, with the presence of a preset amount of gap between itself and the inward surface of the fixation roller 7. More concretely, the external diameter of the heating assembly 1 is smaller than the internal diameter of the fixation roller 7. It is made up of a cylindrical holder 2, an excitation coil 5, first to third cores 6*a*, 6*b* and 6*c*, a stay 3, etc. The holder 2 is cylindrical and is longer than the fixation roller 7. The excitation coil 5, first to third cores 6*a*, 6*b*, and 6*b*, and stay 3 are positioned in the hollow of the cylindrical holder 2. The first to third cores 6*a*, 6*b*, and 6*b* are made of a magnetic substance, and are aligned in parallel to each other in such a manner that the cross section of the combination of the first to third cores 6*a*, 6*b* and 6*c* appears T-shaped.

The holder 2 in this embodiment is molded of a compound made by mixing glass into PPS resin, which is heat resistant and mechanically very strong. Obviously, it is nonmagnetic. As for the material for the holder 2, nonmagnetic substances such as PPS resin, PEEK resin, polyimide resin, polyamide resin, polyamide-imide resin, ceramic, liquid polymer, fluorinated resin, or the like are suitable.

More concretely, the holder 2 is made up of a pair of semicircular halves, that is, first and second sections 2*a* and 2*b*, into which it is separable by a plane which roughly coincides with the axial line of the holder 2. The two semicircular sections 2*a* and 2*b* are separately molded. The aforementioned coil 5, cores 6*a*, 6*b* and 6*c*, and stay 5 are placed in the first semicircular section 2*a*. The stay 3 is a member for holding the coil 5, cores 6*a*, 6*b* and 6*c*, etc.

The second semicircular section 2*b* is glued to the first semicircular section 2*a* in a manner of covering the opening side of the first semicircular section 2*a*. By the way, the two semicircular sections 2*a* and 2*b* may be shaped so that they can be interlocked with each other to yield the cylindrical holder 2. As the second semicircular section 2*b* is glued to (or interlocked with) the first semicircular section 2*a*, the coil 5, cores 6*a*, 6*b* and 6*c*, stay 3, etc., are locked into the hollow of the first semicircular section 2*a*, yielding the roughly cylindrical holder 2 which contains the coil 5, cores 6*a*, 6*b* and 6*c*, stay 3, etc.

Figure 4:
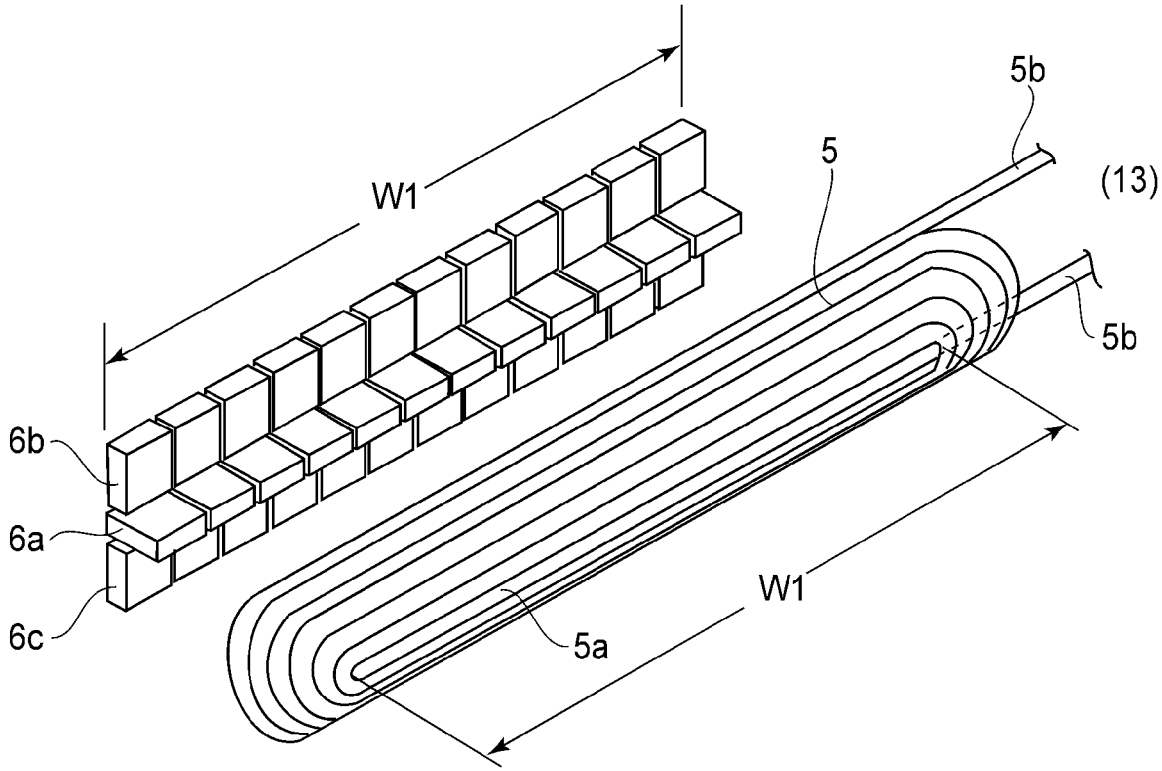
FIG. 4 is an exploded schematic perspective view of the combination of the excitation coil and magnetic core.

Referring to FIG. 4 which is an exploded schematic perspective view of the combination of the excitation coil and magnetic core, the coil 5 is wound in such a manner that its overall shape is roughly in the form of an oval, the major axis of which is parallel to the lengthwise direction of the fixation roller 7. The coil 5 is fitted within the hollow of the first semicircular section 2*a*, in such an attitude that its outward facing side contacts the inward surface of the semicircular section 2*a*. The coil 5 is shaped so that its lengthwise direction is parallel to the lengthwise direction of the fixation roller 7.

The coil 5 must be capable of generating alternating magnetic flux by an amount large enough to properly heat the fixation roller 7. Thus, it must be low in resistance, and high in inductance. In this embodiment, litz wire which is made of 20-200 strands of electrically conductive wire which are coated with an insulator and is 0.1-0.50 mm in external diameter, is used as the material for the coil 5. More concretely, litz wire made of 140 strands of electrically conductive wires which are 0.17 mm in diameter, and which is 4 mm in overall diameter, is used as the material for the coil 5. In anticipation of a possibility that the coil 5 will excessively increase in temperature, a heat resistant insulator is used as the material for coating each of the multiple strands of wire, of which litz wire is made.

The first core 6*a* is the section of the magnetic core 6, which corresponds to the vertical section of a letter T. It corresponds in position to the center 5*a* of the coil 5 in terms of the direction of the minor axis of the coil 5. The second and third cores 6*b* and 6*c*, respectively, correspond to the horizontal section of a letter T. Referring again to FIG. 4 which is an exploded schematic perspective view of the combination of the excitation coil 5 and magnetic core 6, each of the cores 6*a*, 6*b*, and 6*c* is made up of multiple short (in terms of lengthwise direction of core 6) sub-cores aligned in the lengthwise direction of the magnetic core 6.

The length of each of the cores 6*a*, 6*b* and 6*c* is roughly equal to the width W1, which is the width of the sheet of recording medium of the normal size. That is, each of the cores 6*a*, 6*b* and 6*c* is perpendicularly positioned relative to the path of the sheet of recording paper of the normal size. As the material for the cores 6*a*, 6*b* and 6*c*, a substance which is high in permeability and small in loss is desirable, from the standpoint of higher efficiency for the magnetic circuit, and blocking of magnetism. For example, a magnetic substance such as ferrite, Permalloy, and the like, which are used as the material for the core of a transformer, is used as the material for the cores 6*a*, 6*b* and 6*c*.

The heating assembly 1 is inserted into the hollow of the fixation roller 7, in such a manner that the left and right end portions 2L and 2R of the holder 2 extend beyond the left and right lengthwise ends of the fixation roller 7, through the left and right end openings of the fixation roller 7, respectively. Further, the left end portion 2L of the holder 2 is stationarily held by the second left plate 30L of the fixation apparatus frame, which is on the outward side of the aforementioned first left plate 12L of the fixation apparatus frame. The right end portion 2R of the holder 2 is stationarily held by the second right plate 30R of the fixation apparatus frame, which is on the outward side of the aforementioned first right plate 12L of the fixation apparatus frame.

The fixing apparatus 100 in this embodiment is structured to position the heating assembly 1 between the left and right second plates 30L and 30R, in such an attitude (angle) that the first semicircular section 2*a* of the holder 2, which holds the coil 5 and cores 6*a*, 6*b* and 6*c*, faces the direction from which the recording medium is introduced into the fixing apparatus 100 (fixing nip N), with the presence of a preset amount of gap between the heating assembly 1 and the inward surface of the heat roller 7. A pair of wires (lead wires) 5*b* for supplying the coil 5 with electrical power extend outward of the holder 2, through the opening of the lengthwise right end 2R of the holder 2, and are in connection to the electric power control circuit 13 (excitation circuit, electromagnetic induction heating means driving circuit, high frequency convertor).

(4) Magnetic Flux Adjusting Apparatus (Device)

Designated by a referential code 101 is a magnetic flux adjusting device. This device 101 is provided with a shutter 18 which functions as a magnetic flux blocking member. The shutter 18 is placed in the gap between the heating assembly 1, and fixation roller 7 (which is inductively heatable member). It is movable in the circumferential direction of the fixation roller 7, along the inward surface of the fixation roller 7. Further, the device 101 has a shutter moving means 25 which can position the shutter 18 in any position in terms of the circumferential direction of the fixation roller 7.

Figure 5:
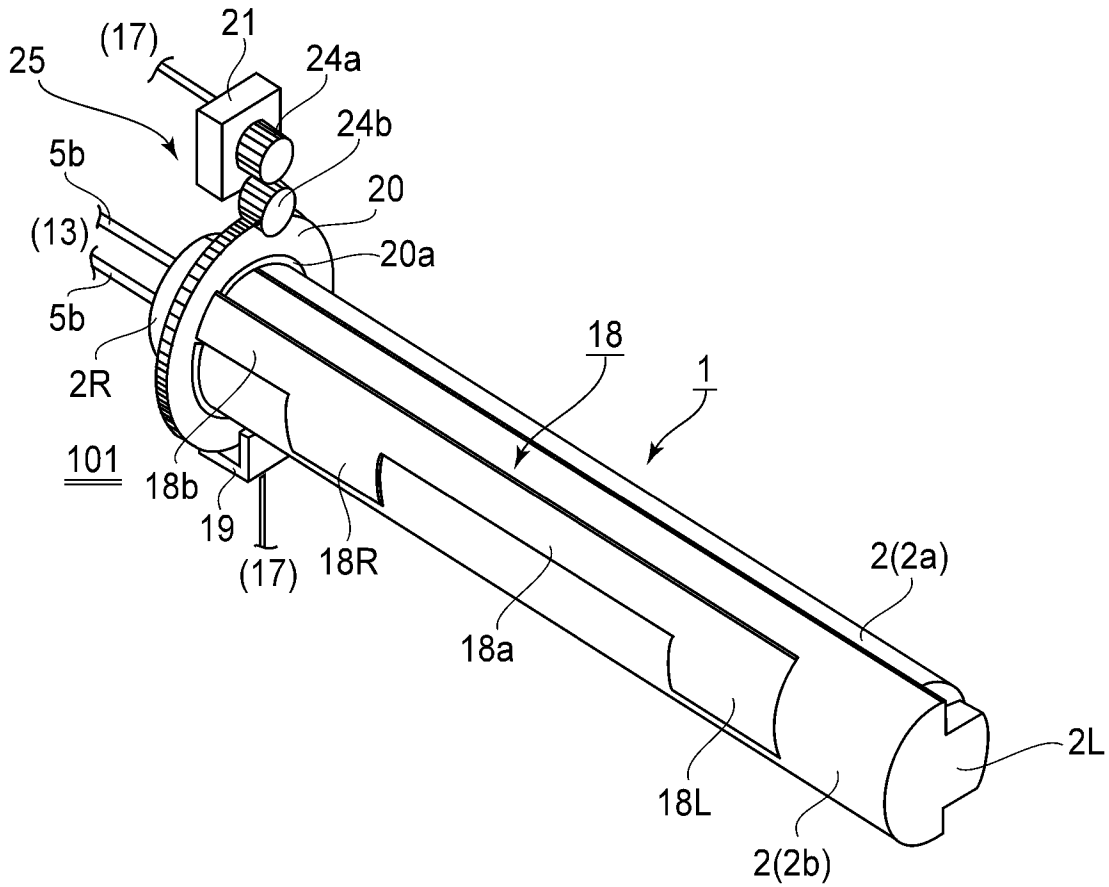
FIG. 5 is a schematic perspective view of the combination of the heating assembly and magnetic flux adjusting apparatus (device).

FIG. 5 is a schematic perspective view of the combination of the heating assembly 1 and magnetic flux adjusting apparatus (device) 101. The magnetic flux adjusting device 101 is provided with a shutter driving circular gear 20, which is fitted around the right end portion 2R of the holder 2 of the heating assembly 1, with the placement of a circular bearing 20*a* between the right end portion 2R and gear 20. The shutter 18 is attached, like a cantilever, by its lengthwise right end 18*b* to the gear 20. Thus, as the gear 20 is rotated, the shutter 18 rotates with the gear 20 in the circumferential direction of the holder 2, about the axial line of the holder 2. That is, as the gear 20 is rotated, the shutter 18 moves in the circumferential direction of the fixation roller 7 while remaining in the gap between the heating assembly 1 and fixation roller 7 (inductively heatable member).

The shutter moving means 25 is made up of the shutter driving gear 20 to which the shutter 18 is attached as described above, a pair of gears 24*a* and 24*b* for transmitting driving force to the shutter driving gear 20, a shutter driving motor 21 as a mechanical power source, etc. The driving gear 20 is provided with a slit (unshown) for detecting the shutter position. Further, the shutter moving means 25 is provided with a gear position sensor 19, which detects the position of the shutter 18 (in terms of circumferential direction of holder 2) by detecting a beam of light as the beam of light comes through the slit.

The shutter 18 has a left shield section 18L and a right shield section 18R, a shield section supporting portion 18*a* (which supports left and right shield sections 18L and 18R), a connective section 20*b* (which is in connection to driving gear 20), etc. In this embodiment, the shutter 18 is shaped so that the left and right shield sections extend from the shield supporting portion 18*a*, following the curvature of the holder 2, in the direction perpendicular to the axial line of the holder 2.

More concretely, the left and right shield sections 18L and 18R are connected to each other by the shield supporting section 18*a*, and are extended in the circumferential direction of the fixation roller 7, in a manner to follow the curvature of the fixation roller 7, to partially block the alternating magnetic flux. The dimension and position of the shield sections 18L and 18R of the shutter 18 in terms of the lengthwise direction of the shutter 18 are set according to the size of a sheet of recording medium which makes it necessary for the magnetic flux to be partially blocked.

From the standpoint of preventing the magnetic flux adjusting member itself from increasing in temperature, copper, aluminum, silver or silver alloy, which are nonmagnetic and conductive enough to allow induction current to flow through them, ferrite which is large in specific resistivity and is capable of confining magnetic flux, and the like substances, are suitable as the material for the shutter 18. Further, magnetic substances such as iron and nickel can also be used as the material for the shutter 18, provided that the shutter 18 is provided with circular holes, and/or slits, for efficiently radiating the heat generated in the shutter 18 by the eddy current.

Normally, the shutter 18 is held in its home position within the gap between the fixation roller 7 and holder 2, that is, the position in which the shutter 18 is kept retracted when the magnetic flux does not need to be partially blocked. The home position is on the opposite side of the holder 2 from the coil 5 of the heating assembly 1 (second semicircular section 2*b* side of holder 2). When the shutter 18 is in its home position, the magnetic flux from the heating assembly 1 does not affect the fixation roller 7 in practical terms.

Figure 6:
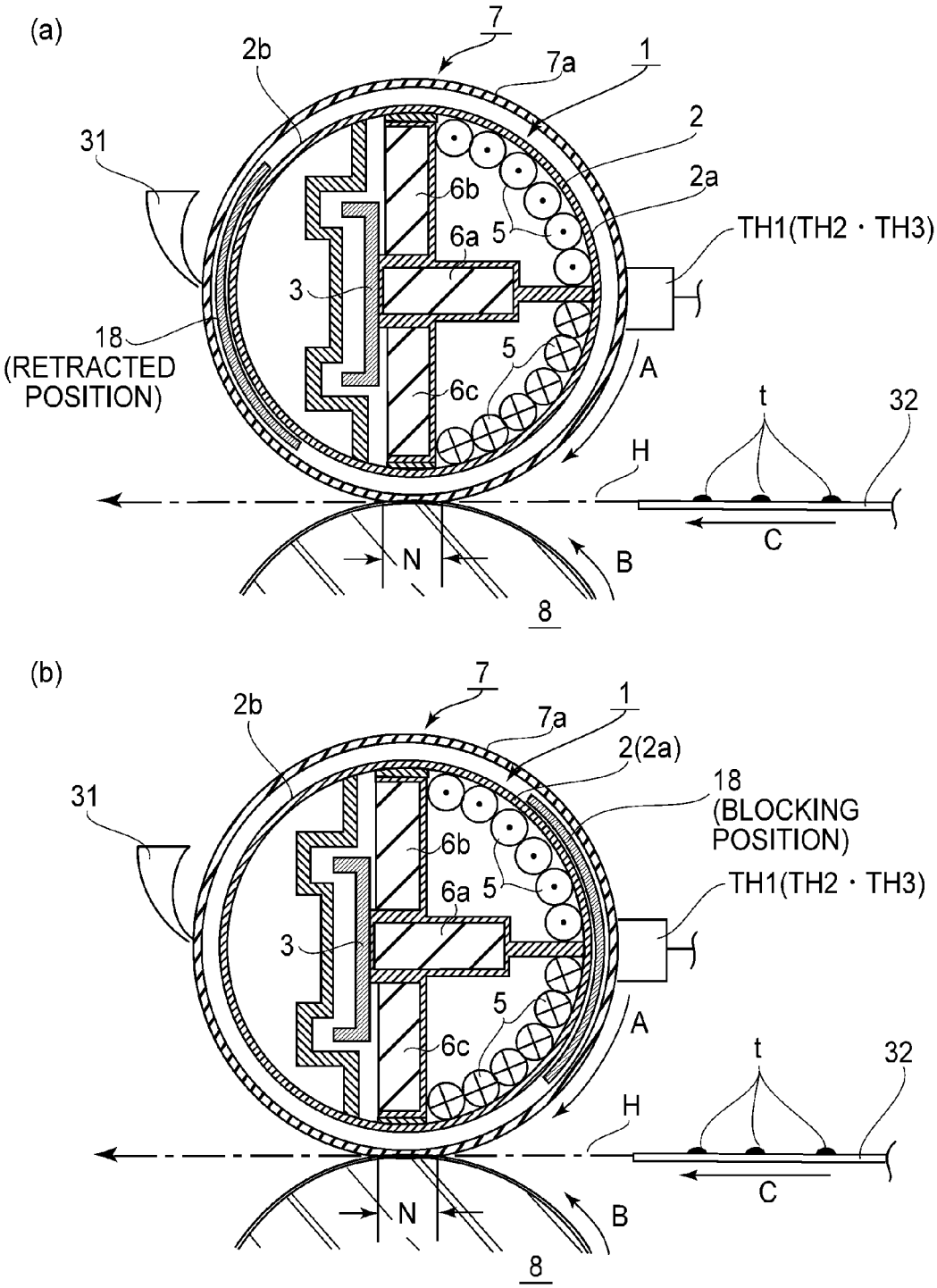
FIG. 6(*a*) is a schematic sectional view of the fixation roller in a state in which the magnetic flux adjusting member is in its home position, that is, the position in which the magnetic flux adjusting member does not block the magnetic flux, and FIG. 6(*b*) is a schematic sectional view of the fixation roller in a state in which the magnetic flux adjusting member is in the position in which the magnetic flux adjusting member partially blocks the magnetic flux.

Referring to FIG. 6(*b*), when it is necessary to partially block the magnetic flux generated by the heating assembly 1, the shutter 18 is held in the blocking position indicated in FIG. 6(*b*), which is on the same side of the fixation roller 7 as the coil 5 of the heating assembly 1 (first semicircular section 2*a* side of holder 2). The blocking position is the position in which the shield sections 18L and 18R of the shutter 18 partially block the magnetic flux generated by the heating assembly 1 to prevent the magnetic flux from reaching the portions of the fixation roller 7, which are outside the recording medium path in terms of the direction perpendicular to the recording medium conveyance direction C.

In this embodiment, the shutter 18 is shaped to shield the portions W3 of the fixation roller 7, which are outside the path of a sheet of recording medium which is being used, from the magnetic flux generated by the heating assembly 1. Therefore, it is possible to prevent the problem that when a substantial number of small (narrow) sheets of recording medium are continuously conveyed through the fixing apparatus 100, the lengthwise end portions of the fixation roller 7, which are outside the path of a sheet of recording medium, tend to excessively increase in temperature.

That is, when the shutter 18 is in its home position shown in FIG. 16(*a*), the alternating magnetic flux are not blocked at all by the shutter 18, being allowed to be guided in entirety to the fixation nip N, by the cores 6*a*, 6*b* and 6*c*, across the entire range of the fixation nip N in terms of the lengthwise direction of the nip N. Therefore, the fixation roller 7 is inductively heated across its entire range.

In comparison, when the shutter 18 is in the position shown in FIG. 16(*b*), that is, the position in which it partially blocks the alternating magnetic flux, the alternating magnetic flux is partially blocked by the shield sections 18L and 18R of the shutter 18 as it is guided toward the fixation nip N by the cores 6*a*, 6*b* and 6*c*. Therefore, it is possible to control the problem that when a substantial number of small (narrow) sheets of recording medium are continuously conveyed through the fixing apparatus 100, the lengthwise end portions of the fixation roller 7, which are outside the path of a sheet of recording medium, tend to excessively increase in temperature.

The movement of the shutter 18 is controlled based on the signals outputted by the gear position sensor 19 to indicate the position of the magnetic flux blocking member 18 (shutter 18), and the signal outputted by the recording medium size sensor (unshown) to indicate the size of the sheet 32 of recording medium which is about to be introduced into the fixation nip N. More concretely, the control circuit 17 drives the motor 21 for moving the magnetic flux adjusting member, in response to those signals, to move the shutter 18 from its home position to the blocking position, or from the blocking position to the home position.

In this embodiment, the means for partially blocking the magnetic flux is the shutter 18 shaped to partially block the magnetic flux which acts on the fixation roller 7. However, this embodiment is not intended to limit the present invention in terms of the means for partially blocking the magnetic flux. For example, the present invention is also applicable to a fixing apparatus structured so that the magnetic member can be moved relative to the coil 5 to change the path of the magnetic flux between the coil and the fixation roller, in order to adjust the fixation roller 7 in the magnetic flux density in terms of the lengthwise direction of the fixation roller 7.

(5) Fixing Operation

The control circuit 17 turns on the driving system 33 with a preset control timing. As the driving system 33 is turned on, the fixation roller 7 begins to be rotated, and therefore, the pressure roller 8 begins to be rotated by the rotation of the fixation roller 7. Further, the control circuit 17 begins to supply the heating assembly 1 with the electric power (high frequency current) from an electric power controlling device 13 (excitation circuit) through a coil supply lines 5*b*. Thus, the fixation roller 7 (component to be heated by electromagnetic induction) is increased in temperature by the heat (Joule heat resulting from loss of eddy current) generated in the wall of the fixation roller 7 by the eddy current generated therein by the function of the magnetic flux (alternating magnetic field) generated by the heating assembly 1.

The temperature of the fixation roller 7 is detected by the temperature detecting first means TH1 (thermistor or the like), which is positioned so that it is virtually in contact with the center of the peripheral surface of the fixation roller 7 in terms of the lengthwise direction of the fixation roller 7. The signals outputted by the temperature detecting first means TH1 to indicate the temperature of the center portion of the fixation roller 7 are inputted into the control circuit 17 (as a temperature controlling means), which is made up of a CPU and such memories as RAM and ROM.

The control circuit 17 controls the amount by which electric power is supplied to the coil 5 of the heating assembly 1 from the electric power controlling device 13, based on the temperature control program stored in the memory, so that the detected temperature of the fixation roller 7, which is inputted from the temperature detecting first means TH1, remains at a preset fixation level (target level).

While the detected temperature of the fixation roller 7 is kept at the preset fixation level, the sheet 32 of recording medium, on which an unfixed toner image t electrostatically formed in the image formation station or image transfer station of the image forming apparatus, is present, is introduced into the fixation nip N of the fixing apparatus 100 through the recording medium conveyance passage H, in the direction indicated by an arrow mark C in FIG. 6, and is conveyed through the fixation nip N while remaining pinched between the fixation roller 7 and pressure roller 8.

While the combination of the sheet 32 of recording medium and the unfixed toner image t thereon is conveyed through the fixation nip N, the unfixed toner image t is fixed to the surface of the sheet 32 by the heat from the fixation roller 7 and the pressure applied by the pressure roller 8. Designated by a referential code 31 is a sheet separating claw, which plays the role of assisting the sheet 31 to separate from the fixation roller 7, by preventing the sheet 32 from wrapping around the fixation roller 7 as the sheet 32 comes out of the fixing nip N after being introduced into the fixation nip N.

In terms of the lengthwise direction of the fixation roller 7, the fixing apparatus 100 is provided with the second temperature detecting means TH2 (first thermistor for shutter) and third temperature detecting means TH3 (second thermistor for shutter). The second temperature detecting means TH2 is for detecting the temperature of the portions of the fixation roller 7, which correspond in position to the out-of-sheet-path portions W of the fixation nip N. It is positioned so that it opposes one of the portions of the peripheral surface of the fixation roller 7, which corresponds in position to the out-of-sheet-path portion of the fixation nip N. The third temperature detecting means TH3 is for detecting the temperature of the portions of the fixation roller 7, which also correspond in position to the out-of-sheet-path portions W of the fixation nip N. It is positioned so that it opposes one of the portions of the peripheral surface of the fixation roller 7, which corresponds in position to the out-of-sheet-path portion of the fixation nip N, and which is on the outward side of the second temperature detecting means TH2 in terms of the lengthwise direction of the fixation roller 7. A target temperature altering means 171 sets, or alters, a value for the target temperature for the fixation roller 7, the temperature of which is controlled by the control circuit 17, based on the temperature detected by the second and third temperature detecting means TH2 and TH3.

(6) Circular Retainer 80

In the case of the fixing apparatus 100 in this embodiment, the circular bearings 11L are fitted around the left end portion of the fixation roller 7, with the placement of the annular heat-insulating bushing 70L between the bearing 11L and fixation roller 7. Further, the flange portion 11*c* (FIG. 3) of the outer ring 11*b* of the bearing 11L is in contact with the outward surface of the fixation roller supporting left frame 12L in terms of the lengthwise direction of the fixation roller 7. This setup controls the movement of the bearing 11L toward the lengthwise center of the fixation roller 7. Further, the flange portion 70*a* of the heat-insulating bushing 70L is in contact with the outward surface of the bearing 11L in terms of the lengthwise direction of the fixation roller 7. Therefore, the heat-insulating bushing 70L is prevented from moving in the direction of the lengthwise center of the fixation roller 7 beyond the bearing 11L.

After the fixation roller gear 10 is fitted around the lengthwise end portion of the fixation roller 7, it is slid toward the lengthwise center of the fixation roller 7 until the protrusion 10*a* of the gear 10 fits into the slot 7*a* of the fixation roller 7, deeply enough for the inwardly facing surface of the protrusion 10*a* to come into contact with the inward end of the slot 7*a*. Thus, the gear 10 is prevented from moving further in the direction of the lengthwise center of the fixation roller 7; the gear 10 is regulated in its movement in the direction of the lengthwise center of the fixation roller 7. As for the outward movement of the gear 10 in terms of the lengthwise direction of the fixation roller 7, it is regulated by the circular retaining means 80L fitted around the lengthwise left end portion of the fixation roller 7, on the left side of the bearing 10. After the proper fitting of the bearing 10 and circular retaining means 80L around the fixation roller 7, the surface of the gear 10, which is facing the lengthwise center of the fixation roller 7, is in contact with the surface of the heat-insulating bushing 70L, which is facing in the opposite direction from the lengthwise center of the fixation roller 7, or a minute gap is present between the two surfaces. In other words, the proper fitting of the circular retaining means 80L around the lengthwise left end portion of the fixation roller 7 keeps the heat-insulating bushing 70L and bearing 11L properly positioned relative to the fixation roller 7, in terms of the lengthwise direction of the fixation roller 7.

As for the positioning of the annular heat-insulating bushing 70R and circular bearing 11R relative to the lengthwise right end portion of the fixation roller 7, the flange portion 11*c* (FIG. 3) of the outer ring 11*b* of the bearing 11R is caught by the surface of the fixation roller supporting left member 12L, which is facing away from the lengthwise center of the fixation roller 7. Thus, the bearing 11R is prevented from moving further in the direction of the lengthwise center of the fixation roller 7. Further, the flange portion 70*a* of the heat-insulating bushing 70R, which is facing in the direction of the lengthwise center of the fixation roller 7, is caught by the surface of the bearing 11R, which is facing away from the lengthwise center of the fixation roller 7. Therefore, the heat-insulating bushing 70R is prevented from moving further toward the lengthwise center of the fixation roller 7. Further, the movement of the heat-insulating bushing 70R in the opposite direction from the lengthwise center of the fixation roller 7 is caught by the circular retaining means 80R fitted around the lengthwise right end portion of the fixation roller 7, on the right-hand side (outward side) of the heat-insulating bushing 70R. Therefore, the heat-insulating bushing 70R is prevented from moving in the opposite direction from the lengthwise center of the fixation roller 7; it is kept properly positioned relative to the right end portion of the fixation roller 7 in terms of the lengthwise direction of the fixation roller 7.

Figure 7:
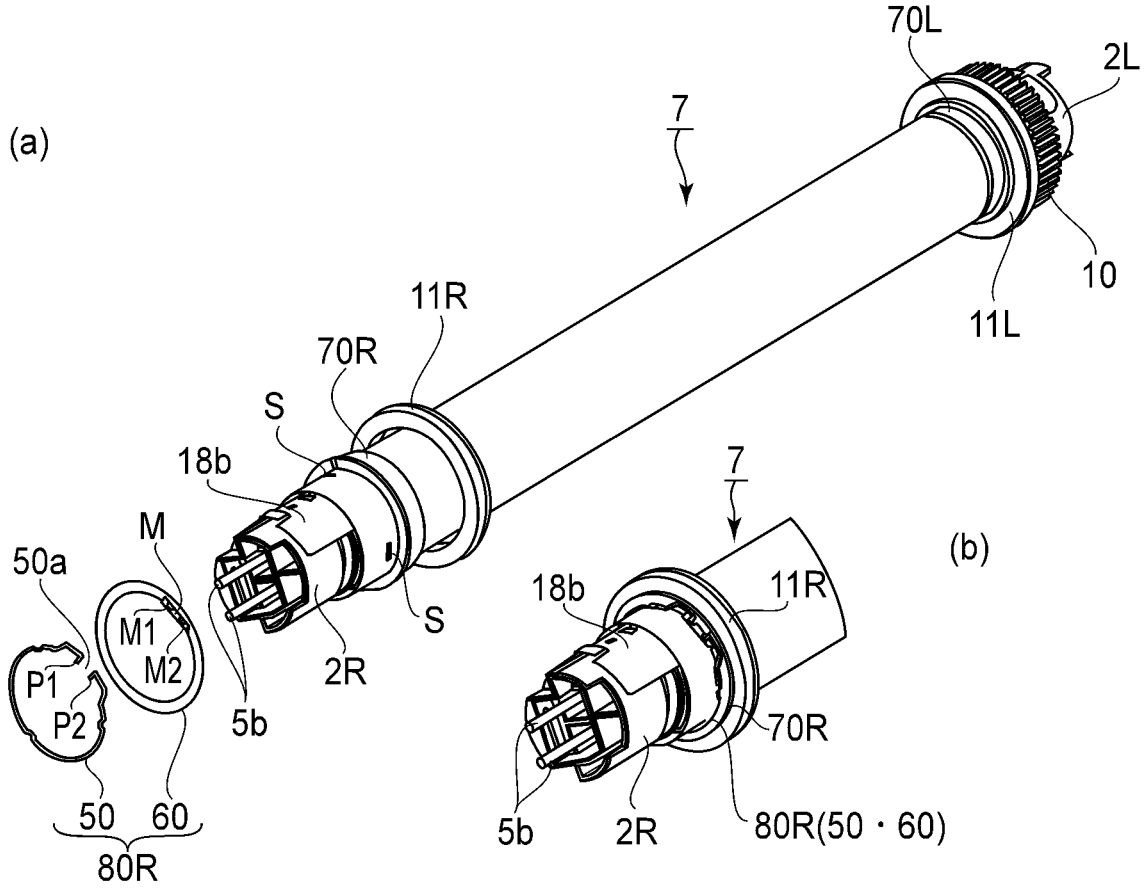
FIG. 7(*a*) is an exploded perspective views of the combination of components fitted around the lengthwise right of the fixation roller, and FIG. 7(*b*) is a perspective view of the combination of components fitted around the lengthwise right end portion of the fixation roller.

In the case of this embodiment, the left and right circular retaining means 80L and 80R are the same in structure. Thus, the right circular retaining means 80R is described as a circular retaining means 80 which represents both the left and right circular retaining means 80L and 80R. FIG. 7(*a*) is an exploded perspective view of the combination of the components fitted around the right end portion of the fixation roller 7. FIG. 7(*b*) is a perspective view of the combination of the components fitted around the lengthwise right end portion of the fixation roller 7 after the fitting of the combination around the right end portion of the fixation roller 7.

The circular retaining means 80R has: a C-shaped retainer clip 50 as a circular regulating member; and a washer 60 which functions as a circular spacer. It is used as a means for controlling the movement of the heat-insulating bushing 70R (which is supported by fixation roller 7, as its axle, and is to be regulated by C-shaped retainer clip 50) in the opposite direction from the lengthwise center of the fixation roller 7. The washer 60 is placed between the heat-insulating bushing 70R and C-shaped retainer clip 50, to prevent the heat-insulating bushing 70R from being shaved by the C-shaped retainer clip 50.

Designated by a referential code 50*a* is a gap (which corresponds to gap letter C has) of the C-shaped retainer clip 50. A referential code 50*b* stands for each of two or more bends with which the C-shaped retainer clip 50 is provided. The bends 50*b* are positioned with a certain amount of interval in terms of the circumference direction of the C-shaped retainer clip 50, and protrude inward of the C-shaped retainer clip 50 (roughly in form of letter V). On the other hand, the lengthwise end portion of the fixation roller 7 is provided with two or more slits Q, which are aligned in the circumference direction of the fixation roller, with the presence of preset amount of intervals. Thus, as the C-shaped retainer clip 50 is fitted around the lengthwise end portion of the fixation roller 7, its two or more V-shaped bends fit into the two or more slits Q, one for one, of the fixation roller 7. In the case of this embodiment, the C-shaped retainer clip 50 is provided with three V-shaped bends 50*b*. Accordingly, the lengthwise end portion of the fixation roller 7 is provided with three slits Q.

The C-shaped retainer clip 50 is fitted around the lengthwise end of the fixation roller 7 in such a manner that its three V-shaped bends are fitted into the three slits Q of the fixation roller 7, one for one. With the C-shaped retainer clip 50 fitted around the lengthwise end portion of the fixation roller 7 as described above, the C-shaped retainer clip 50 is kept precisely positioned relative to the fixation roller 7, being prevented from moving either toward the lengthwise center of the fixation roller 7, or in the opposite direction from the lengthwise center of the fixation roller 7.

As described above, the fixing apparatus 100 in this embodiment has: the shutter 18 which is positioned in the gap between the heating assembly 1 and fixation roller 7 (inductively heatable member), and which is movable in the circumferential direction of the fixation roller 7; and shutter moving means 25 for moving the shutter 18 to any of preset positions in the gap between the heating assembly 1 and fixation roller 7 in terms of the circumferential direction of the fixation roller 7; etc. Further, the fixing apparatus 100 is structured to ensure that 1.2 mm of clearance C, in terms of the direction parallel to a line tangential to the inward circumference of the fixation roller 7, is provided between the shutter 18 and the inward surface of the fixation roller 7, as indicated by the hatching in FIG. 8(*a*). The reason for providing 1.2 mm of clearance in terms of the direction parallel to the tangential line is as follows:

In order to reduce the fixing apparatus 100 in energy consumption, and also, in the length of time it takes to start up the apparatus 100, electromagnetic induction was used to heat the fixation roller 7. Further, fixation roller 7 was reduced in thermal capacity by making the wall thickness of the fixation roller 7 0.65 mm in order to reduce the fixation roller 7 in thermal capacity. Moreover, the fixing apparatus 100 was structured so that the clearance between the heating assembly 1 and fixation roller 7 becomes 1.2 mm. This arrangement can confine, as much as possible, the magnetic flux generated by the heating assembly 1 (as magnetic flux generating means), within the ferromagnetic metallic wall of the fixation roller 7, and therefore, can improve the fixation apparatus 100 in heat generation efficiency.

The C-shaped retainer clip 50 in this embodiment was formed by bending a piece of wire, the cross section of which is in the form of a 1 mm square. Each of the lengthwise end portions of the fixation roller 7 is provided with the aforementioned three slots Q, in which the three V-shaped bends of the C-shaped retainer clip 50 fit one for one. The dimension of each slit Q in terms of the circumferential direction of the fixation roller 7 is 8.0 mm, and the dimension of each slit Q in terms of the lengthwise direction of the fixation roller 7 is 1.2 mm. It is in these slits Q that the three V-shaped bends of the C-shaped retainer clip 50 are fitted one for one.

As for the shape and dimension of the C-shaped retainer clip 50, the amount of the inward protrusion of each V-shaped bend 50*b* relative to the peripheral surface of the fixation roller 7 was made to be 0.95 mm, because the thickness of the wall of the fixation roller 7 is 0.65 mm, and the amount of the protrusion of the each V-shaped bend 50*a* from the inward surface of the fixation roller 7 is 0.35 mm. Therefore, it is ensured that 0.85 mm of clearance is provided between the V-shaped bend 50 of the C-shaped retainer clip 50 and rotationally movable shutter 18.

The C-shaped retainer clip 50 has to be enabled to be fitted around the lengthwise end portion of the fixation roller 7 and also, to externally clump onto the fixation roller 7. Therefore, it has to be springy. Thus, it has to be shaped so that until it is fitted around the fixation roller 7, the dimension of the gap 50*a* of the C-shaped retainer clip 50 is virtually zero. The C-shaped retainer clip 50 is formed by bending a piece of wire as described above. However, because of the relationship in terms of clearance between the fixation roller 7 and shutter 18, each of the three vends of the C-shaped retainer clip 50 has to be shaped roughly in the form of a letter V.

As the fixation roller 7 stops rotating, the C-shaped retainer clip 50 also stops. However, because the bends 50*b* of the C-shaped retainer clip 50 are in the form of a letter V for the reason given above, the inertia of the C-shaped retainer clip 50 causes the V-shaped bends of the C-shaped retainer clip 50 to slightly slide out of the slit 7*a* of the fixation roller 7, causing thereby the axial line of the C-shaped retainer clip 50 to become offset from the axial line of the fixation roller 7. Then, as the fixation roller 7 begins to be rotated again, the heat-insulating bushing 70R and gear 10 slip relative to the fixation roller 7. Therefore, the C-shaped retainer clip 50, which rotates with the fixation roller 7, is subjected to a force (braking force) which works in the direction to disengage the C-shaped retainer clip 50 from the fixation roller 7.

According to the studies made by the inventors of the present invention, when the amount of the thrust to which the C-shaped retainer clip 50 is subjected is roughly 294 N, the component (braking force) of this thrust, which works in the direction to disengage the C-shaped retainer clip 50 from the fixation roller 7 because of the coefficient of static friction (friction at moment when fixation roller begins to be rotated) is roughly 5 N. In comparison, the amount of the force required to open (widen gap 50*a*) the C-shaped retainer clip 50 is roughly 1.8 N. Therefore, the portion of each bend 50*a* of the C-shaped retainer clip 50, which corresponds to the slant stroke of a letter V is subjected to such an amount of force (=F sin θ−a) that presses the V-shaped bend of the C-shaped retainer clip 50 outward of the slit Q. That is, shaping the bends 50*a* of the C-shaped retainer clip 50 in the form of a letter V makes it easier for the bends 50*a* to slide relative to the fixation roller 7 (edge of slit Q of fixation roller 7) in the direction to come out of the slit Q. A referential code J in FIG. 8(*a*) stands for the angle of one of the lateral portions of the bend 50*a*.

Figure 10:
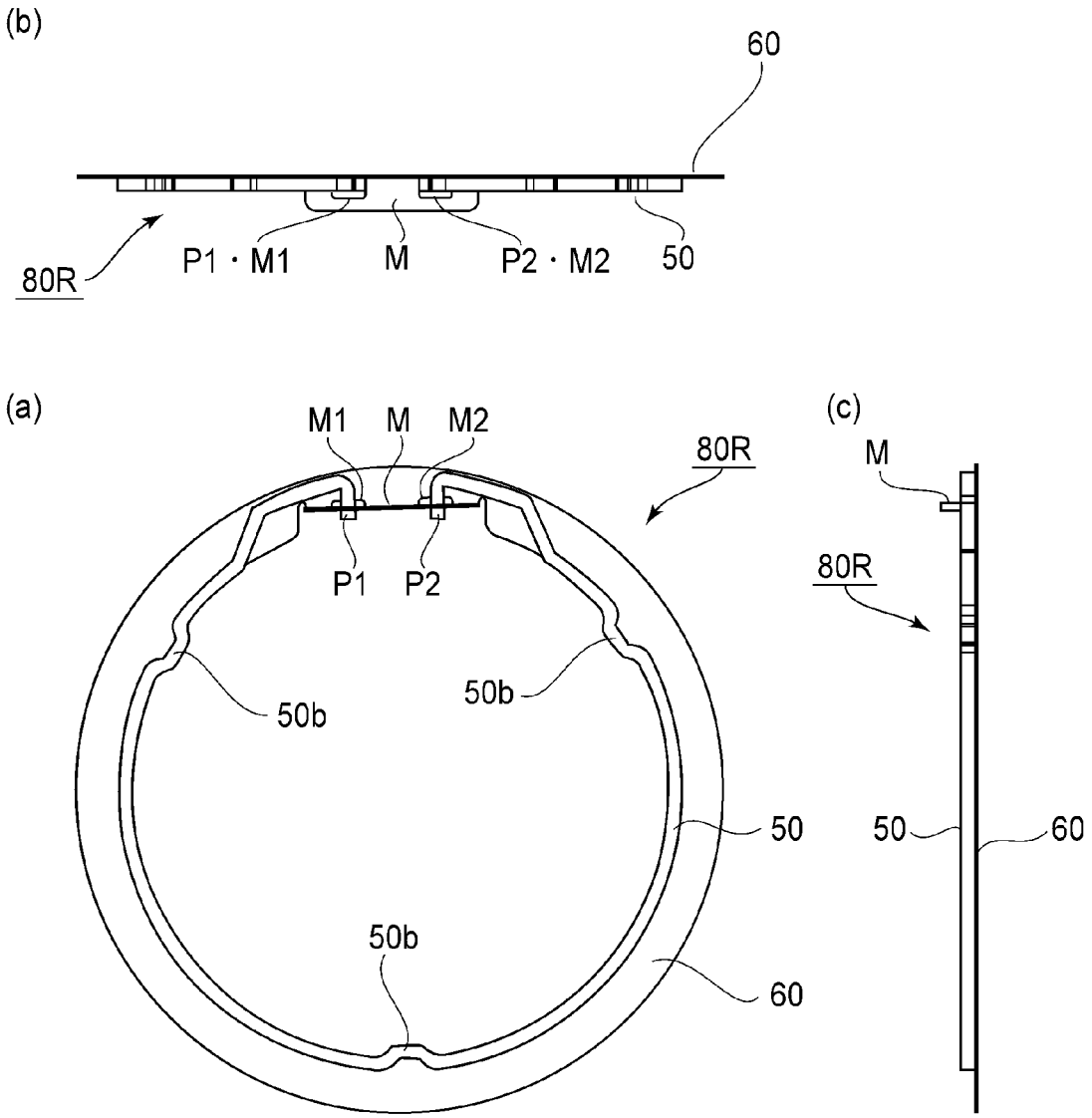
FIG. 10 is a drawing for describing the area of engagement between the washer and C-shaped retainer clip (position fixing means).
Figure 11:
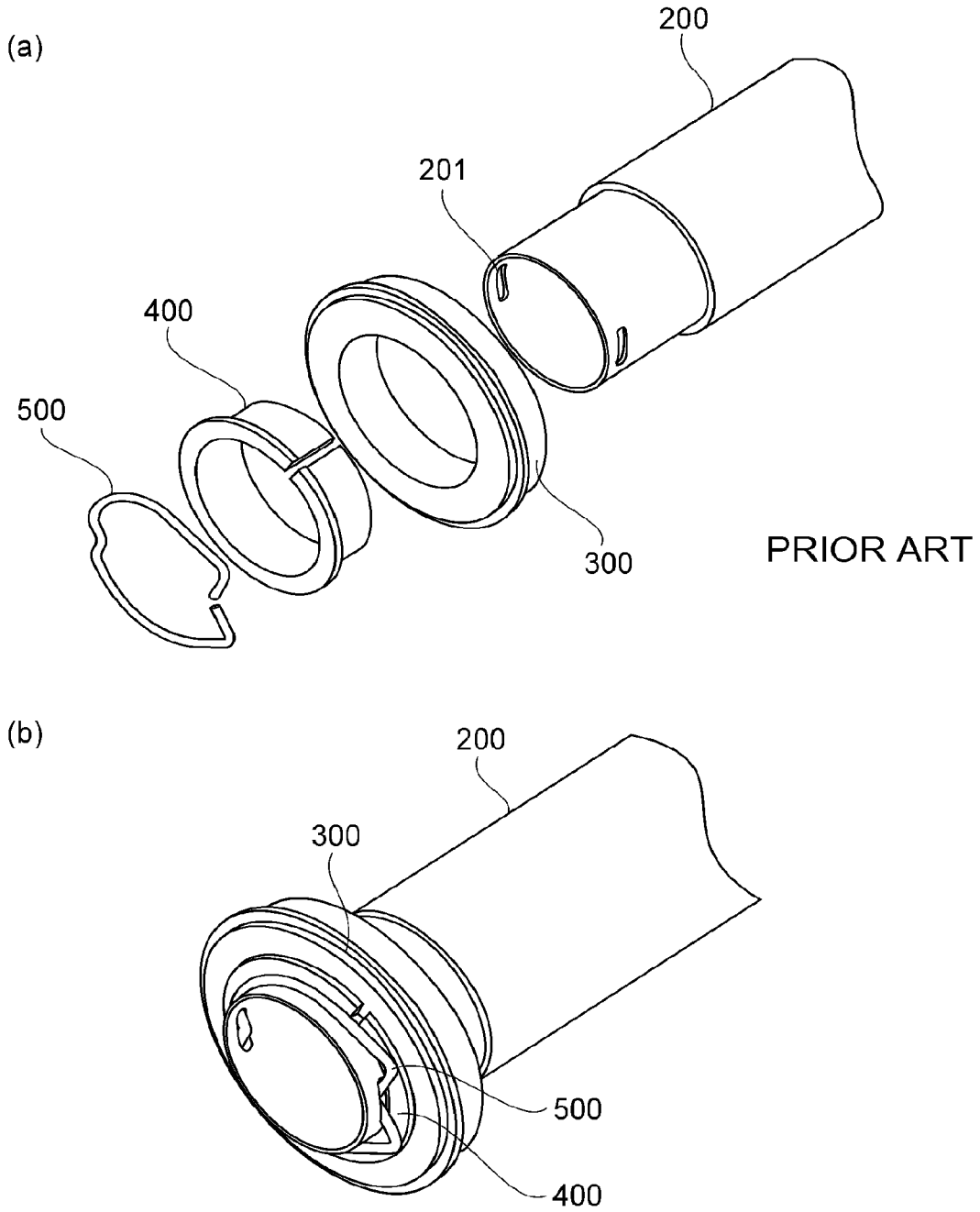
FIGS. 11(*a*) and 11(*b*) are perspective views of one of the combination of components fitted around the lengthwise end portions of a conventional fixation roller, and shows the structure of the combination and how the combination is assembled.

Referring to FIG. 10, in this embodiment, therefore, the washer 60, which is to be placed between the heat-insulating bushing 70R and C-shaped retainer clip 50, is provided with a portion M to which the C-shaped retainer clip 50 is to be anchored. In other words, the C-shaped retainer clip 50 is provided with a pair of washer hooking portions, and is anchored to the washer 60 by its washer hooking portions P1 and P2 (which hereafter will be referred to simply as hooking portions) to prevent the above described problem that the bends 50*a* of the C-shaped retainer clip 50 tend to come out of the slits Q of the fixation roller 7; the C-shaped retainer clip 50 tends to disengage from the fixation roller 7.

In the case of the C-shaped retainer clip 50 in this embodiment, which is shown in FIG. 10, the end portions of the C-shaped retainer clip 50, which correspond to the gap 50*a* of the C-shaped retainer clip 50, are bent toward the center of the C-shaped retainer clip 50, creating thereby the hooking portions P1 and P2. Correspondingly, the washer 60 is provided with an extension M, that is, the aforementioned C-shaped retainer clip 50 anchoring portion M, to which the C-shaped retainer clip 50 is anchored by its hooking portions P1 and P2. The C-shaped retainer clip 50 anchoring portion M perpendicularly extends outward from the peripheral portion of the washer 60, in terms of the lengthwise direction of the fixation roller 7, and is provided with a pair of hooking portion anchoring holes M1 and M2, into which the hooking portions P1 and P2 are inserted, respectively.

The extension M is perpendicular to the area of contact between the washer 60 and C-shaped retainer clip 50, and also, to the direction in which the C-shaped retainer clip 50 is anchored to the washer 60 by its hooking portions P1 and P2. It is provided with the pair of holes M1 and M2, into which the hooking portions P1 and P2, which correspond to the opening 50*a* of the C-shaped retainer clip 50, are inserted, respectively.

Figure 8:
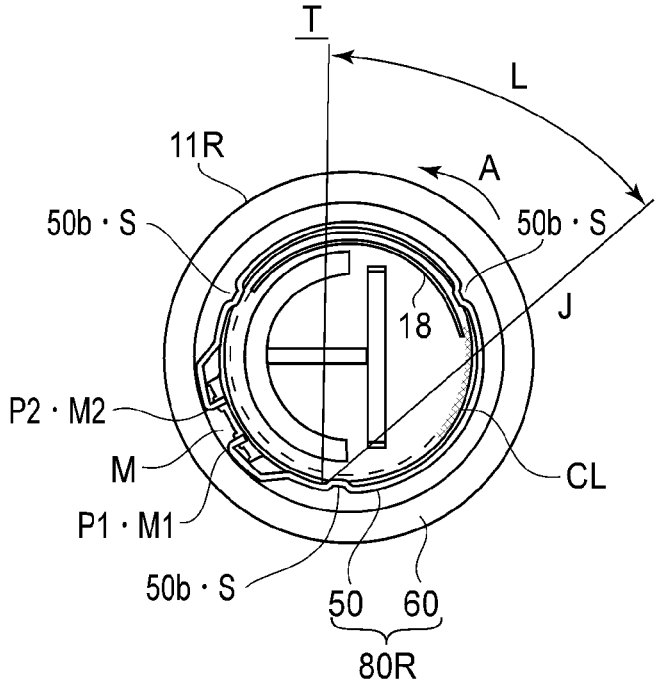
FIGS. 8(*a*) and 8(*b*) are drawings for describing the clearance between the magnetic flux adjusting member and the inward surface of the fixation roller, and the area of engagement between the bends of retainer clip and fixation roller.
Figure 8:
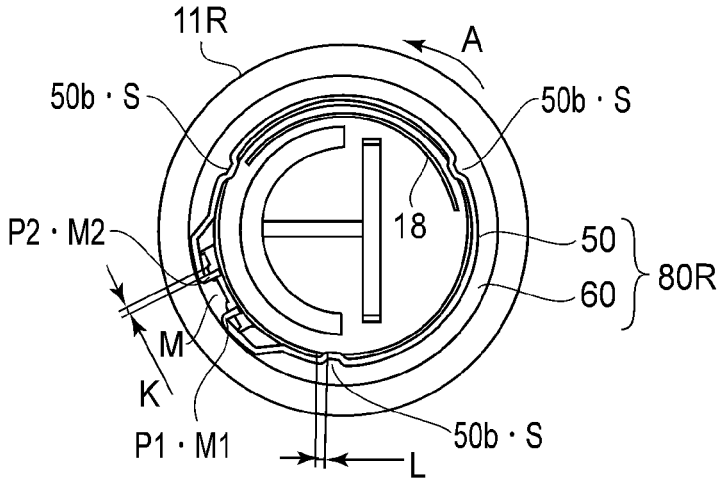
Figure 9:
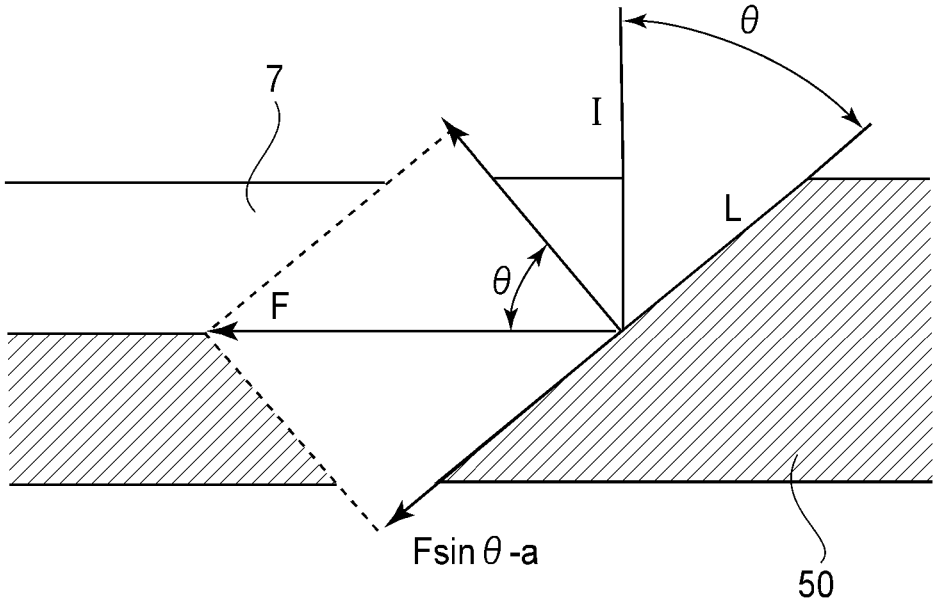
FIG. 9 is a drawing for indicating the direction in which the V-shaped bend (inwardly protruding bend) of the C-shaped retainer clip comes out of the through hole of the fixation roller.

Next, referring to FIGS. 8(*a*) and 8(*b*), a letter L stands for the distance which each of the V-shaped bends 50*a* of the C-shaped retaining clip 50 moves before it comes out of the corresponding slit Q of the fixation roller 7 (distance between edge of slit Q of fixation roller 7 and V-shaped bend of C-shaped retaining clop 50). A letter K stands for the distance between the edge of the hole M1 of the C-shaped retaining clip 50 anchoring extension M and the hooking portion P2 of the C-shaped retaining clip 50 (distance between C-shaped retaining clip 50 anchoring portion of washer 60 and hooking portion of C-shaped retaining clip 50).

The problem that the bends 50*b* of the C-shaped retainer clip 50 comes (slides) out of the slit Q of the fixation roller 7 can be prevented by designing the fixing apparatus 100 so that K and L satisfy an inequality (K<L). A letter L stands for the angle by which a piece of wire was bent to form each of the V-shaped bends of the C-shaped retainer clip 50.

The above-described embodiment of the present invention can be summarized as follows: The present invention proposes a design for the C-shaped retainer clip 50 which can prevent the problem that even when each of the V-shaped bends 50*b* of the C-shaped retainer clip 50 comes into contact with the edge of the corresponding slit Q of the fixation roller 7 (about which C-shaped retainer clip 50 is rotatable), it does not slide out of the slit Q of the fixation roller 7.

That is, the present invention proposes such a structural arrangement for an image heating apparatus (fixing apparatus) that can prevent the problem that as the V-shaped bend

50*b* of the C-shaped retainer clip 50 is pressed against the edge of the slit Q of the fixation roller 7, it slides out of the slit Q. More concretely, in order to prevent the problem that as the V-shaped bend 50*b* of the C-shaped retainer clip 50 is pressed against the edge of the slit Q of the fixation roller 7, it slides out of the slit Q, the present invention proposes to provide the opposing ends of the C-shaped retainer clip 50 with the hooking portions P1 and P2, and the washer 60 with the C-shaped retainer clip 50 anchoring portion M having the pair of holes, and prevent the problem by inserting the hooking portions P1 and P2 into the holes of the C-shaped retainer clip 50 anchoring portion M of the washer 60.

With the implementation of the structural arrangement proposed by the present invention, the C-shaped retainer clip 50 and washer 60 are made to rotate together by the engagement between the hooking portions P1 and P2 of the C-shaped retainer clip 50 and the C-shaped retainer clip 50 anchoring portion M of the washer 60. Therefore, even if the dimension of each of the V-shaped bends 50*b* of the C-shaped retainer clip 50 in terms of the diameter direction of the fixation roller 7 is the same as the thickness of the wall of the fixation roller 7, the C-shaped retainer clip 50 remains anchored to the fixation roller 7 (about which C-shaped retainer clip 50 can rotate). Further, because the dimension of each of the V-shaped bends 50*b* of the C-shaped retainer clip 50 in terms of the diameter direction of the fixation roller 7 is the same as the thickness of the wall of the fixation roller 7, it is ensured that there is the clearance CL between the inward end of the V-shaped bend 50*b* and holder 2.

(7) Miscellanies

1) Although the circular retaining means 80 in accordance with the present invention was described with reference to the right circular retaining clip 80R, the left circular retaining clip 80L is the same as the right circular retaining clip 80R in structure and function.

2) The present invention is applicable also to a fixing apparatus structured so that the hooking portions P1 and P2, with which the opposing ends of the C-shaped retainer clip 50 are provided, and which are to be inserted into the holes of the C-shaped retainer clip 50 anchoring portion M (extension) of the washer 60, face outward (opposite direction from the virtual center of the circular retaining clip C-shaped retainer clip 50 in terms of the radius direction of the fixation roller 7.

3) The structural arrangement for locking the C-shaped retainer clip 50 and washer 60 to each other does not need to be limited to the one in the above described embodiment. All that is necessary for the present invention to be applicable to a given fixing apparatus (image heating apparatus) is that the fixing apparatus is structured so that the C-shaped retainer clip 50 remains properly attached to the washer 60 in order to prevent the C-shaped retainer clip 50 from being opened wide enough for the C-shaped retainer 50 to disengage from the fixation roller 7.

4) The present invention was described above with reference to a fixing apparatus in accordance with the present invention. In principle, however, the present invention is related to a circular retaining means 80 (clip) for retaining a component which is to be fitted around a rotational or non-rotational axle, at a preset position in terms of the direction parallel to the axial line of the axle. Thus, the application of the present invention is not limited to a fixing apparatus such as the one described above. For example, the present invention is also applicable to a gloss increasing apparatus for reheating a fixed toner image on a sheet of recording medium in order to increase the toner image in gloss.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 226635/2011 filed Oct. 14, 2011, which is hereby incorporated by reference.

What is claimed is:

1. An image heating apparatus comprising:

a hollow heating roller having a hole at an axial end portion thereof;

a bearing supporting said heating roller at an outer surface of said heating roller;

a heat insulating bush fitted between an outer surface of said heating roller and said bearing;

a retaining ring configured to retain a position of said heat insulating bush relative to said heating roller in an axial direction of said heating roller, said retaining ring including a projecting portion configured to engage with said hole; and an annular spacer provided at a position between said retaining ring and said heat insulating bush, wherein said spacer includes a connecting portion having a connecting hole, and said retaining ring includes a hooking portion configured to engage with said connecting hole.

2. An apparatus according to claim 1, wherein said retaining ring has circumferential ends having respective hooks, which are engaged with connecting holes provided in said connecting portion, respectively.

3. An apparatus according to claim 1, wherein said heat insulating bush is provided with a flange portion contactable to one end surface of said bearing.

4. An apparatus according to claim 3, wherein said spacer is disposed between said retaining ring and said flange.

5. An apparatus according to claim 1, further comprising an excitation coil, provided inside said heating roller, configured to perform electromagnetic induction heating of said heating roller.

6. An apparatus according to claim 5, further comprising a magnetic flux confining member, provided between said heating roller and said excitation coil, configured to suppress a magnetic flux oriented toward a predetermined region of said heating roller from said excitation coil.

7. An image heating apparatus comprising:

a hollow cylindrical heating member having a hole at an axial end portion thereof;

a bearing member supporting said heating roller at an outer surface of said heating roller;

a heat insulating member fitted between an outer surface of said heating member and said bearing member;

an annular retaining member configured to retain a position of said heat insulating member relative to said heating member in an axial direction of said heating member, said annular retaining member including a projecting portion configured to engage with said hole; and an annular spacer member provided between said heat insulating member and said annular retaining member, wherein said annular retaining member and said annular spacer are connected with each other so as not to rotate relative to each other, and wherein said annular spacer includes a connecting portion having a connecting hole, and said annular retaining member includes a hooking portion configured to engage with said connecting hole.

8. An apparatus according to claim 7, wherein said heat insulating member is provided with a flange portion contactable to one end surface of said bearing member.

9. An apparatus according to claim 8, wherein said annular spacer member is disposed between said annular retaining member and said flange portion.

10. An apparatus according to claim 7, further comprising an excitation coil, provided inside said heating member, configured to perform electromagnetic induction heating of said heating member.

11. An apparatus according to claim 10, further comprising a magnetic flux confining member, provided between said heating member and said excitation coil, configured to suppress a magnetic flux oriented toward a predetermined region of said heating member from said excitation coil.

* * * * *